US007696457B2

(12) United States Patent
Baxter et al.

(10) Patent No.: US 7,696,457 B2
(45) Date of Patent: Apr. 13, 2010

(54) ADJUSTABLE MAGNETIC SEPARATOR

(75) Inventors: Raymond J. Baxter, Vermillion, OH (US); Robert G. Zuccarelli, Hudson, OH (US)

(73) Assignee: Nordson Corporation, Westlake, OH (US)

( * ) Notice: Subject to any disclaimer, the term of this patent is extended or adjusted under 35 U.S.C. 154(b) by 1770 days.

(21) Appl. No.: 10/780,984

(22) Filed: Feb. 18, 2004

(65) Prior Publication Data

US 2005/0035112 A1 Feb. 17, 2005

Related U.S. Application Data

(60) Provisional application No. 60/481,241, filed on Aug. 16, 2003.

(51) Int. Cl.
*H05B 6/16* (2006.01)
*H05B 6/22* (2006.01)

(52) U.S. Cl. ..... 219/653; 219/647

(58) Field of Classification Search ..... 219/647–650, 219/652–656, 604, 660, 672; 209/609, 636; 414/199, 507, 508
See application file for complete search history.

(56) References Cited

U.S. PATENT DOCUMENTS 2,475,895 A * 7/1949 Hill ..... 242/476.9
3,604,611 A * 9/1971 Lamberty ..... 228/36
3,769,135 A * 10/1973 Wallington ..... 264/320
4,036,376 A * 7/1977 Ide ..... 414/140.8
4,364,466 A * 12/1982 Mojden ..... 198/461.2
4,539,456 A * 9/1985 Mohr ..... 219/604
5,180,898 A * 1/1993 Alden et al. ..... 219/388
5,483,042 A * 1/1996 Sprenger et al. ..... 219/647
5,529,703 A 6/1996 Sprenger et al.
5,669,156 A * 9/1997 Vejchoda ..... 34/248
2001/0004999 A1 * 6/2001 Perseke et al. ..... 242/474.2

FOREIGN PATENT DOCUMENTS

GB 1 226 686 3/1971
WO WO 93/16570 8/1993

OTHER PUBLICATIONS

International Search Report from PCT/U52004/026097.
Mountaingate ICD Series Induction Dryers; Customer Product Manual; Part 1018438A; Nordson Corporation, Amherst, Ohio, USA Issued Feb. 2002.

* cited by examiner

*Primary Examiner*—Tu B Hoang
*Assistant Examiner*—Hung Nguyen
(74) *Attorney, Agent, or Firm*—Calfee, Halter & Griswold LLP

(57) ABSTRACT

A magnetic separator has a funnel-shaped inlet opening that is adapted to admit and align any misaligned workpieces moving into the separator. A view port for enables viewing of the pole pieces from a location other than the inlet opening and the outlet opening. The view port is preferably formed in a lower guide plate. The separator has a jack screw adjustment mechanism for adjusting the vertical position of the upper guide plate relative to the lower guide plate. An adjustment mechanism for adjusting the vertical position of the upper pole piece relative to the upper guide plate includes an adjustment screw that is accessible from the top of the separator The upper guide plate is easily removable from the separator by removing only one fastener per side.

9 Claims, 6 Drawing Sheets

ADJUSTABLE MAGNETIC SEPARATOR

RELATED APPLICATION

This application claims the benefit of U.S. Provisional patent application No. 60/481,241 filed Aug. 16, 2003, the entire disclosure of which is fully incorporated herein by reference.

BACKGROUND OF THE INVENTION

The present invention relates to a magnetic separator that is especially adapted to separate plate-like metal objects such as metal can lids, also known as "closures" or "ends".

Closures for metal beverage containers are generally of a circular shape with a flanged perimeter called a curl. The closures, or ends, are usually made of aluminum or steel, and the curl is used in attaching the end to a can body through a seaming operation. To aid the integrity of the seal thus formed between the can body and the end, it is a common practice to apply a bead of sealant or adhesive ("compound") within the curl during manufacture of the end. Different types of coatings are also selectively or generally applied to can ends and can bodies for various other purposes as well, for example, to repair damaged coatings. For the purposes of the present description, coatings, sealants and adhesives are all considered to be "liquids" applied to a workpiece.

It is necessary in this manufacturing operation to cure or dry such liquids. It is known to dry can ends by infrared radiation, convection heating, or induction heating.

An induction heater, for example, typically includes a cabinet that supports a tube extending generally horizontally across the cabinet from one end to the other. An induction coil is wrapped around the tube. The ends move through the tube in a stacked relationship, that is, with abutting face-to-face contact with each other. When a suitable current is passed through the coil, the metal can ends are inductively heated. The heat is transferred to the compound on the can ends by conduction. The compound is heated and water is driven off from the compound into the surrounding air.

When the can ends exit the dryer, the compound on the can ends is substantially dry. A small amount of moisture may still be present in the compound, however. In addition, the can ends exit the dryer in a condition stacked adjacent each other (in a "stick"). Therefore, it is known to provide a magnetic separator at the outlet end of the dryer. The separator separates the can ends from each other by a small space, for example, one quarter inch. This separation facilitates final drying of the compound on the can ends. This separation also facilitates the grabbing of the can ends individually by a rotating wheel at the outlet end of the separator, as is necessary for further use and processing of the can ends.

The stick of ends coming into the inlet end of the separator may include some ends that stick up from the others. In some prior art separators, this can cause jamming or other problems.

The can ends are guided through the separator by upper and lower guide members that are solid metal pieces and therefore block the view of the pole plates. This can make it more difficult to adjust accurately the position of the pole plates, which determines magnetic strength.

In the prior art separator, the steps needed to adjust the vertical positions of the guide plates and the pole pieces can be tedious and may need to be repeated to set the adjustment properly. In addition, the upper guide plate is not easily removable to gain access to areas of the separator.

SUMMARY OF THE INVENTION

The present invention relates to a magnetic separator having for metal objects such as metal can lids, also known as "closures" or "ends". In one aspect of the invention, the separator has an inlet opening that is adapted to admit and align any misaligned workpieces moving into the separator. This may be accomplished by providing an upper guide plate with a funnel-shaped configuration.

In another aspect of the invention, the separator has a view port for enabling viewing of the lower pole piece from a location other than the inlet opening and the outlet opening, i.e., from the side. The view port is preferably formed in a lower guide plate of the separator.

In another aspect of the invention, the separator has an adjustment mechanism for adjusting the vertical position of the upper guide plate relative to the lower guide plate. In a preferred embodiment, the adjustment mechanism includes a jack screw that has a first portion connected for vertical movement with the upper guide plate and a second portion that is threadedly received in a frame portion of the separator. Rotation of the screw about the axis causes axial movement or the upper guide plate relative to the frame portion.

In still another aspect of the invention, the separator includes an adjustment mechanism for adjusting the vertical position of the upper pole piece relative to the upper guide plate. In a preferred embodiment, the adjustment mechanism includes an adjustment screw that is accessible from the top of the separator.

Yet another aspect of the invention relates to a mechanism for enabling easy removal of the upper guide plate from the separator. The mechanism preferably includes only one fastener per side which when removed, enables the upper guide plate to be slidable longitudinally along the frame out of the separator.

BRIEF DESCRIPTION OF THE DRAWINGS

The foregoing and other features of the present invention will become apparent upon consideration of the following description of the invention with reference to the accompanying drawings, in which.

DETAILED DESCRIPTION OF THE INVENTION

Figure 1:
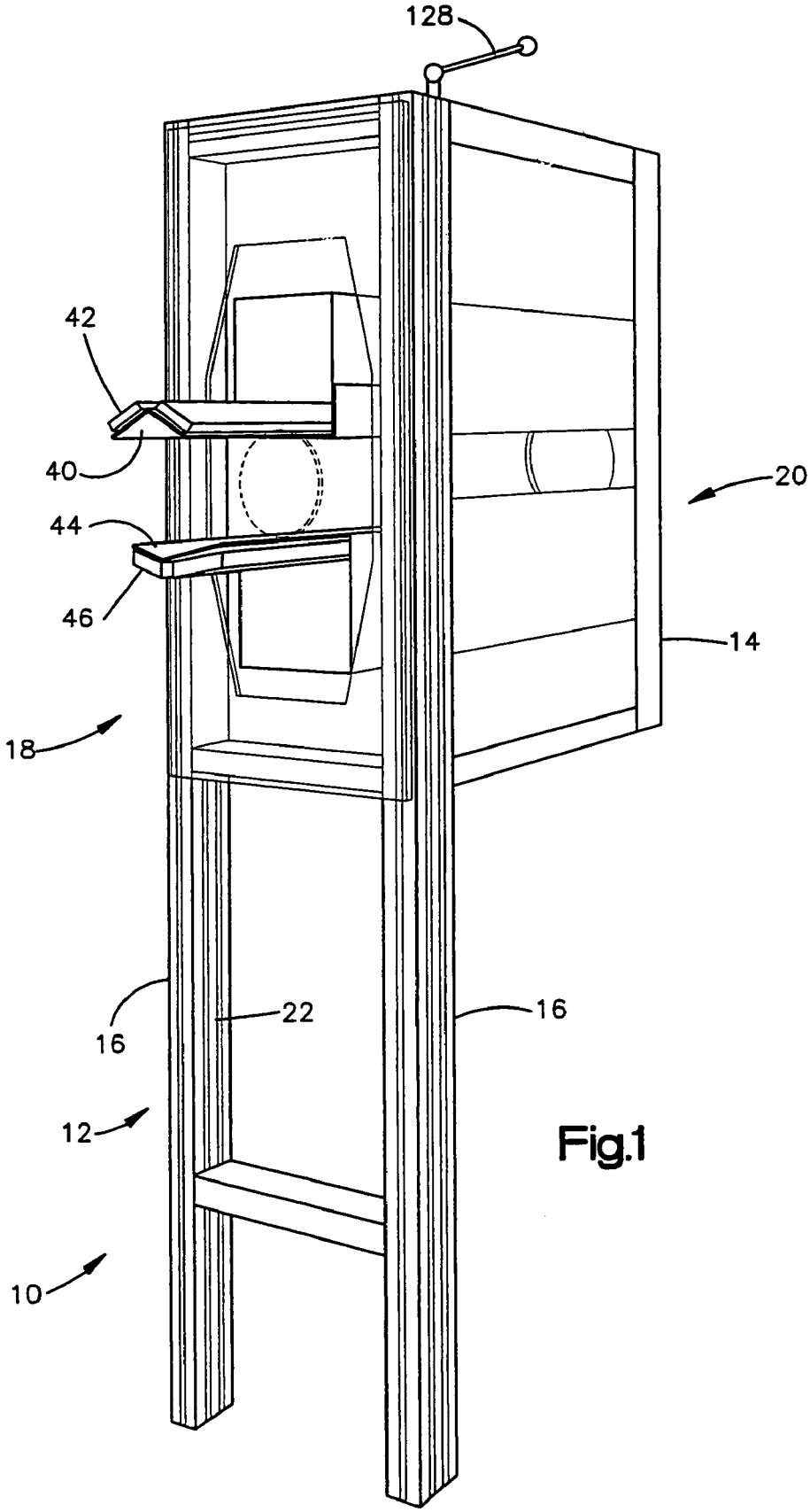
FIG. 1 is a perspective view of a separator in accordance with one embodiment of the invention, taken from a front or outlet end of the separator.

The present invention relates to a magnetic separator for plate-like metal objects such as metal can lids, also known as "closures" or "ends". The invention is applicable to separators of differing constructions. As representative of the invention, FIGS. 1-7 illustrate a separator 10 constructed in accordance with one embodiment of the invention.

The separator 10 includes a frame 12. The frame 12 includes two back uprights 14 and two front uprights 16. The two back uprights 14 are located at the inlet end 18 of the separator 10, and the two front uprights 16 are located at the outlet end 20 of the separator 10. The uprights 14 and 16 provide the frame 12 with a generally rectangular configuration. The back uprights 14 enable the inlet end 18 of the separator 10 to be connected with the outlet of a dryer (not shown), such as an induction dryer. The uprights 14 and 16 have slots 22 for receiving fasteners in a manner slidable along the length of the uprights.

The frame 12 includes at least two sub-frames that interconnect the uprights 14 and 16. One of the sub-frames 30 is located at the top of the separator 10, and includes a cross-bar 32 that extends between the left and right sides. The sub-frame 30 is fixed in position on the uprights 14 and 16. Another one of the sub-frames 34 is located part way down the uprights 14 and 16, from the top. The sub-frame 34 is adjustably supported on the uprights 14 and 16 for vertical sliding movement along the uprights, in a manner as described below.

The separator 10 includes an upper M-channel, or guide plate, 40 and a lower M-channel, or guide plate 44. The upper and lower guide plates 40 and 44 define between them a passage 41. The passage 41 has an intermediate portion 43 disposed between an inlet opening 45 and an outlet opening 47. The guide plates 40 and 44 guide movement of workpieces 48 (FIG. 6) through the separator 10, from the inlet opening 45 to the outlet opening 47, along the passage 41.

The separator 10 also includes an upper pole piece or magnet assembly 42, and a lower pole piece or magnet assembly 46. The upper and lower pole pieces 42 and 46 provide a magnetic field that supports and separates the workpieces 48 from each other as they move through the separator 10 from the inlet end 18 to the outlet end 20. This separation assists in drying of the workpieces 48 and in proper removal of the workpieces from the separator 10 at the outlet end 20.

Figure 3:
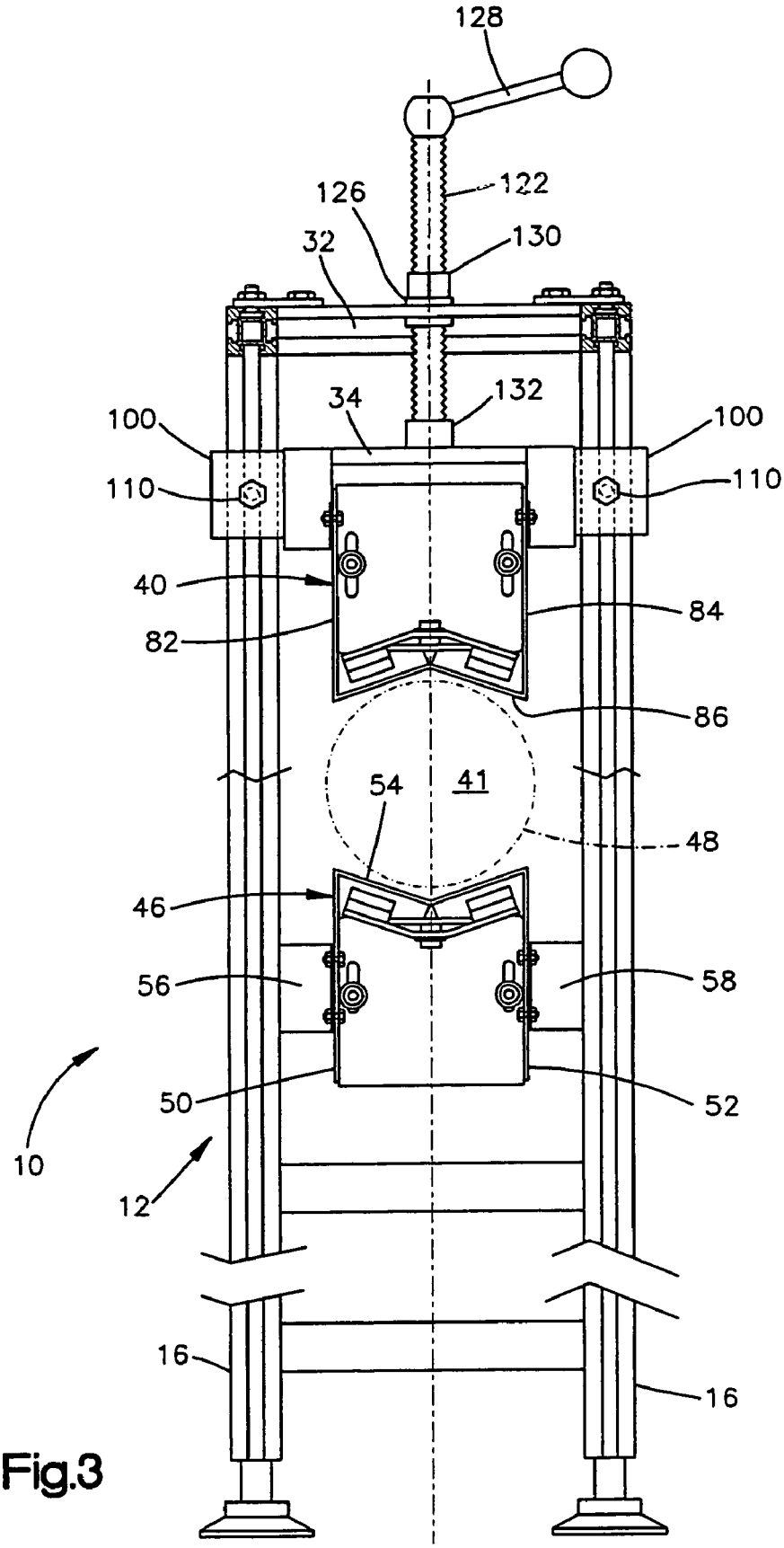
FIG. 3 is a front elevational view of the separator of FIG. 1.
Figure 4:
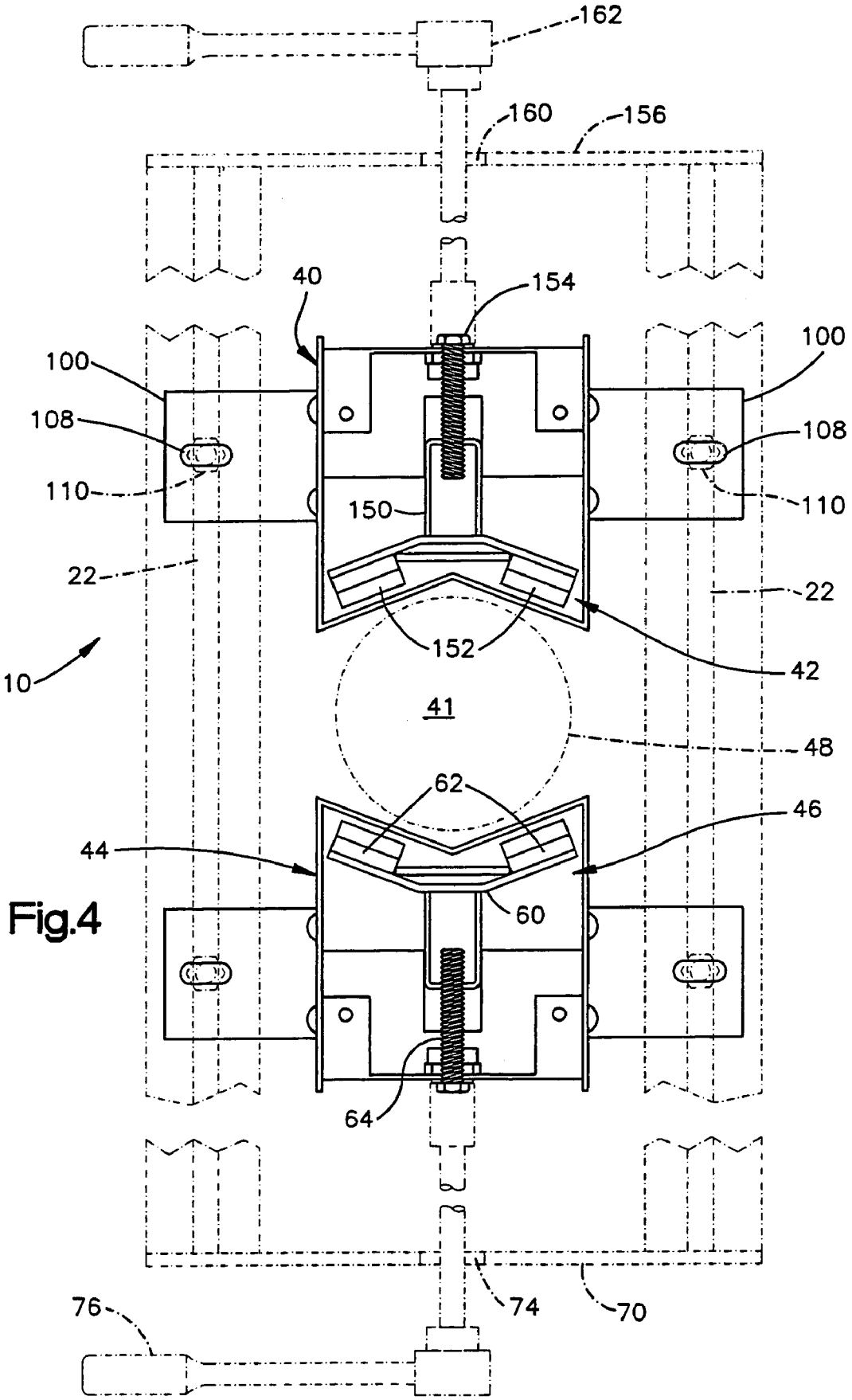
FIG. 4 is an enlarged front elevational view of portions of the separator of FIG. 1.

The lower guide plate 44 has a generally M-shaped cross-sectional configuration, as best seen in FIGS. 3 and 4, including first and second side walls 50 and 52 that are interconnected by a V-shaped upper end wall 54. The lower guide plate 44 has an intermediate portion 51 that extends between an inlet end portion 53 and an outlet end portion 55 of the lower guide plate. The inlet end portion 53 of the lower guide plate 44 extends parallel to the intermediate portion 51 of the lower guide plate.

A pair of first mounting brackets 56 adjustably connects the first side wall 50 of the lower guide plate 44 with the frame 12. A pair of second mounting brackets 58 adjustably connect the second side wall 52 of the lower guide plate 44 with the frame 12. As a result, the lower guide plate 44 is adjustably supported on the frame 12 so that it can be positioned at different vertical locations along the uprights 14 and 16. This adjustment is not normally needed, since the lower guide plate 44 is set to the outlet of the dryer and it is the upper guide plate 40 that is adjusted when more or less space between the guide plates 40 and 44 is needed.

The lower pole piece 46 (FIG. 4) includes a frame 60 that supports two permanent magnets 62. The magnets 62 extend along the length of the separator 10. The frame 60 is supported at each end on an adjustment screw 64 threaded in the lower guide plate 44. The frame 60 and the adjustment screws 64 are thus supported on the lower guide plate 44.

The heads of the adjustment screws 64 are accessible from underneath the lower pole piece 46 and the lower guide plate 44. The separator 10 includes a lower cover 70 that has removable plugs 72 fitted in openings 74 in the lower cover. When one of the plugs 72 is removed as shown in FIG. 4, the head of the associated adjustment screw 64 is accessible. The adjustment screw 64 can be reached with a socket on a six-inch extension on a socket wrench, as shown in phantom at 76. As a result, the lower pole piece 46 is adjustably supported by the lower guide plate 44 on the frame 12, so that it can be positioned at different vertical locations relative to the upper guide plate 44 and also, separately, relative to the frame 12. The lower pole piece 46 adjustment is set to the outlet of the dryer and is also changed when the material thickness of the ends 48 changes.

Because the inlet end 18 of the separator 10 is connected with the dryer when the separator is in use, it might not be feasible to view the position of the back end portion of the lower pole piece 46. In accordance with one aspect of the invention, the lower guide plate 44 has at least one view port 80 for enabling viewing of the lower pole piece 46, thereby to accurately adjust the position of the lower pole piece, which determines the strength of the magnetic field on the workpieces 48.

Figure 5:
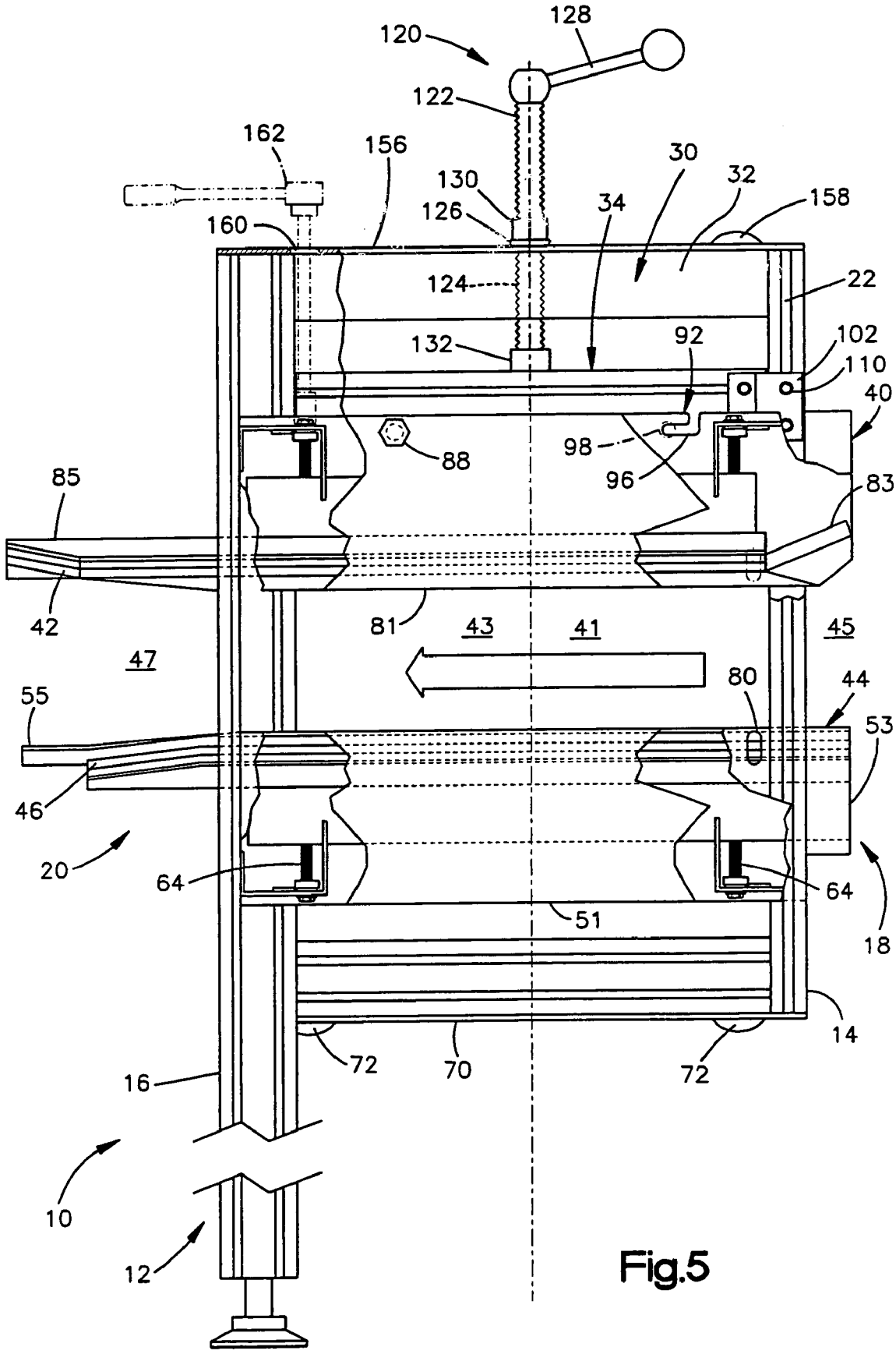
FIG. 5 is a side elevational view of the separator of FIG. 1, with some parts broken away.
Figure 7:
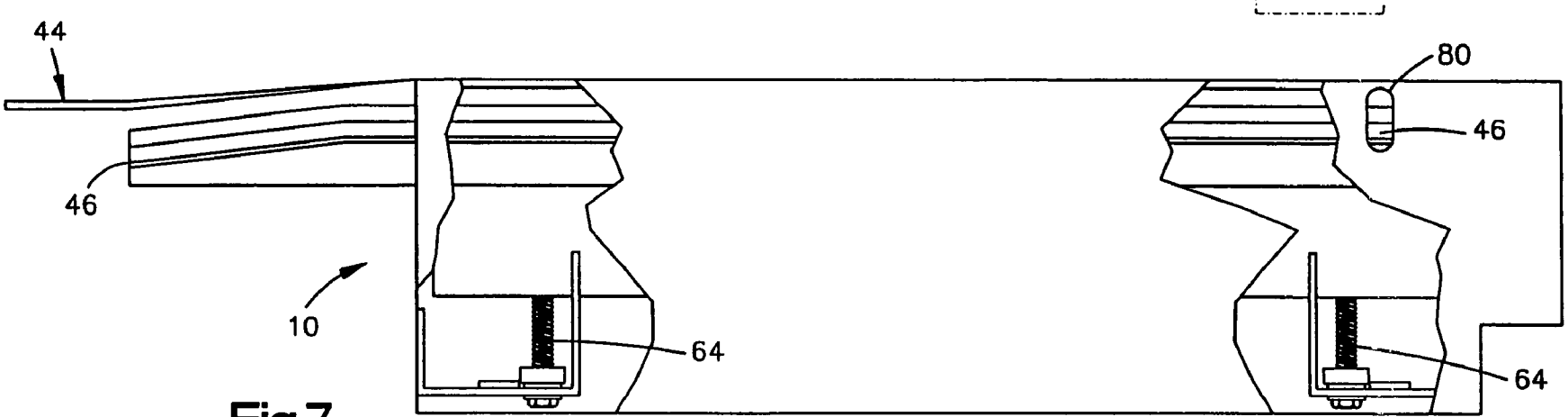
FIG. 7 is an enlarged side elevational view of the a portion of FIG. 1, with some parts broken away.

The view port 80 is located in the second side wall 52 of the lower guide plate 44 and is shown in FIGS. 5 and 7. The view port 80 is an opening formed in the material of the second side wall 52 of the lower guide plate 44. The opening 80 is located near the top of the second side wall 52 of the lower guide plate 44. The opening 80 has an oval configuration with an upright long axis. Suitable view ports 80 could have different shapes than the one illustrated. The height of the opening 80 is selected to enable viewing, through the opening, of the lower pole piece 46, at any point within the range of adjustment of the lower pole piece relative to the lower guide plate 44.

The view port 80 is located near the inlet end, or back end, of the lower guide plate 44. The lower pole piece 46 is located inside the M-shaped lower guide channel 44. As a result, the view port 80 enables viewing of the vertical position of the back end of the lower pole piece 46. The presence of the view port 80 thereby enables accurate adjustment of the position of the lower pole piece 46, which determines strength of the magnetic field on the workpieces 48.

The upper guide plate 40 is similar in configuration to the lower guide plate 44, but reversed in orientation. The upper guide plate 40 thus has a generally W-shaped cross-sectional configuration, as best seen in FIGS. 3 and 4, including first and second side walls 82 and 84 that are interconnected by a V-shaped lower end wall 86. The upper guide plate 40 has an intermediate portion 81 has portions that extend between an inlet end portion 83 and an outlet end portion 85 of the upper guide plate. The inlet end portion 83 of the upper guide plate 40 extends transverse to the intermediate portion 81 of the upper guide plate, as described below.

Two bolts 88 secure the outlet end 85 of the upper guide plate 40 to the sub-frame 34 (only one bolt 88 may be needed, on one side only). A releasable mechanism 92 supports the inlet end 83 of the upper guide plate 40 on the sub-frame 34. Specifically, at the inlet end 83 of the upper guide plate 44, two L-shaped slots 96 on the side walls 82 and 84 receive pins or screws 98 that stick out from the sub-frame 34. The engagement of the pins 98 in the slots 96 supports the inlet end 83 of the upper guide plate 40 on the sub-frame 34.

A pair of first mounting brackets 100 adjustably connect the sub-frame 34 with the front uprights 16. In a similar manner, a pair of second mounting brackets 102 adjustably connect the sub-frame 34 with the back uprights 14. Each one of the mounting brackets 100 and 102 has a fastener opening 108 that receives a fastener in the form of a bolt 110. The bolts 110 have portions that are received in the slots 22 in the front and back uprights 16 and 14 of the frame 12.

The four bolts 110 may be loosened or tightened to releasably secure the uprights 14 and 16 at different locations along the length of the uprights. When the four bolts 110 are loosened, the upper guide plate 40 and the sub-frame 34 are adjustable on the frame 12 so that they can be positioned at different vertical locations along the uprights 14 and 16. When the four bolts 10 are tightened, the upper guide plate 40 is fixed in position on the frame 12. Because the adjustment bolts 110 are provided at both the inlet end 83 and the outlet end 85 of the upper guide plate 40, the two ends of the upper guide plate can be set at different vertical positions along the uprights 14 and 16, to tilt the upper guide plate relative to horizontal, as is sometimes desired.

In accordance with another aspect of the invention, the separator 10 includes an adjustment mechanism 120 by which the position of the upper guide plate 40 is easily adjustable from above the separator, once the four bolts 110 are loosened. The adjustment mechanism 120 includes an adjusting screw or jack screw 122. The jack screw 122 extends vertically through an opening 124 in the cross bar 32 in the sub-frame 30. The jack screw 122 is threadedly received in a collar 126 in the opening 124. As a result, rotation of the jack screw 122 about its axis causes the screw to move vertically relative to the frame 12 of the separator 10. A handle 128 is located on the upper end of the jack screw 122. A lock nut 130 is located on the jack screw 122 adjacent the collar 126.

The lower end of the jack screw 122 is rotatably captured in a collar 132 fixed in the sub-frame 34 fixed for movement with the upper guide plate 40. As a result, vertical movement of the jack screw 122 results in vertically directed force being applied to the upper guide plate 40.

When the operator desires to adjust the vertical position of the upper guide plate 40, the operator loosens the four adjusting bolts 110 and also loosens the lock nut 130. The operator turns the handle 128, causing the jack screw 122 to rotate relative to the frame 12. Rotation of the jack screw 122 acts to draw the sub-frame 34 and thus the upper guide plate 40 upward or downward as desired. When the desired position of the upper guide plate 40 is reached, the lock nut 130 and the four adjusting bolts 110 are tightened to fix the upper guide plate in position on the frame 12.

Another manner of adjustment of the upper guide plate 40 is possible. Specifically, the four adjusting bolts 110 can be configured and set to allow them to hold the upper guide plate 40 in position when in use, but allow it to slide along the uprights 14 and 16 when sufficient vertical force is applied. If that is done, then the adjusting bolts 110 do not need to be loosened before the handle 128 is turned. Simply turning the handle 128, alone, can provide enough force to move the upper guide plate 40 vertically along the uprights 14 and 16.

Figure 2:
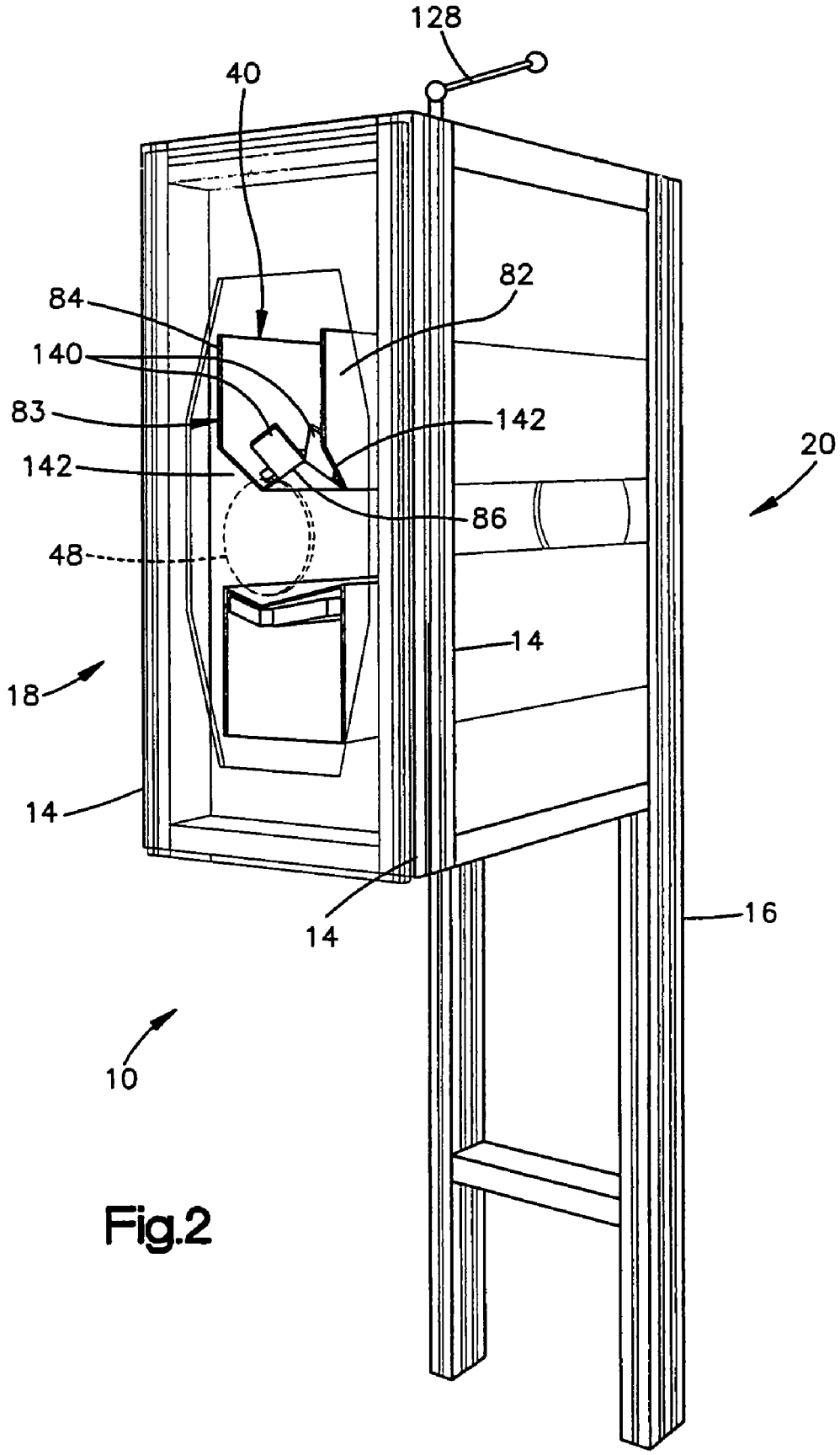
FIG. 2 is a perspective view of the separator of FIG. 1, taken from a back or inlet end of the separator.
Figure 6:
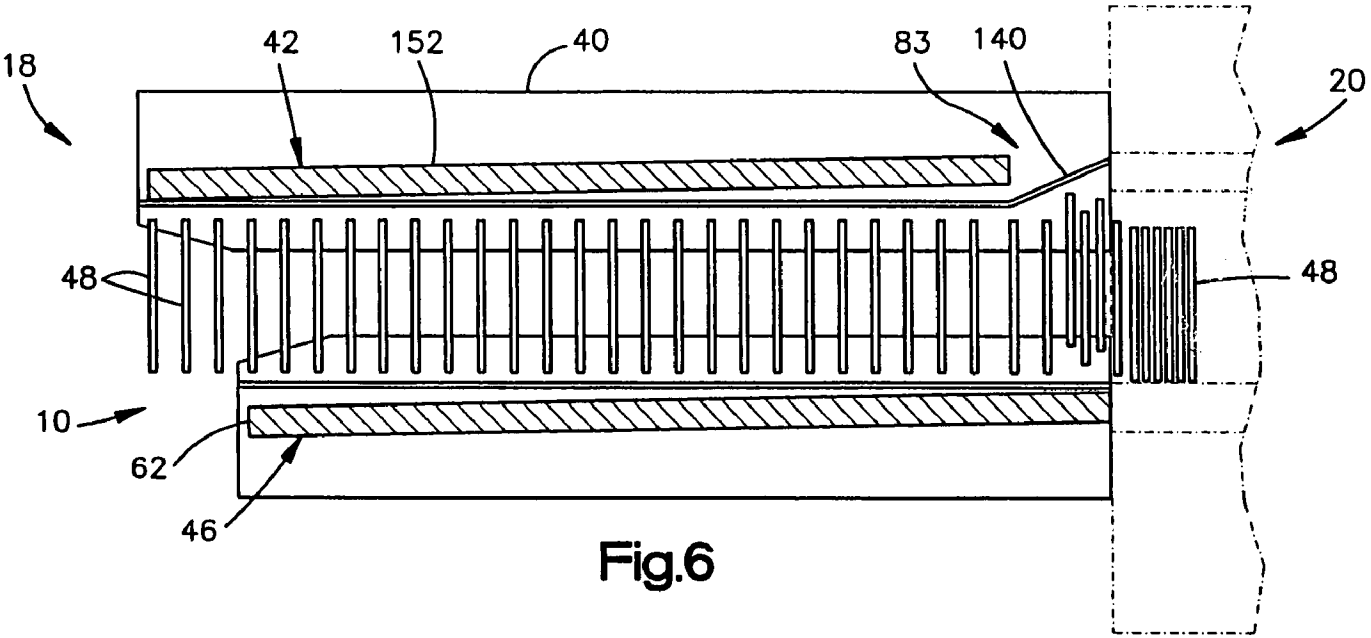
FIG. 6 is a schematic side view of a portion of the separator of FIG. 1 showing a plurality of workpieces in the separator.

In accordance with a further aspect of the invention, the configuration of the upper guide plate 40 is adapted to guide any workpieces 48 that might be out of position in the stick, at the inlet end 18 of the separator 10. Specifically, as can be seen in FIGS. 2 and 6, outer side portions of the lower end wall 86 of the upper guide plate 40, at the inlet end 83 of the upper guide plate, are removed. The remaining central portion of the inlet end 83 of the upper guide plate 40 is split and is turned upward as two tabs 140. The tabs 140 face backward (that is toward the dryer to which the separator 10 is connected) and downward. In addition, the side walls 82 and 84 of the upper guide plate 40 are cut away as shown at 142, to provide clearance.

The inlet end portion 83 of the upper guide plate 40 thus is flared upward to form a funnel at the inlet end 18 of the separator 10. The inlet opening 45 of the passage 41 is thus substantially larger in cross-sectional area than the intermediate portion 43 of the passage. This funnel shape of the upper guide plate 40 can catch and redirect any out of position workpieces 48 into their proper position in the stick. This can help to prevent jams and otherwise ensure smooth operation of the separator 10.

In accordance with another aspect of the invention, the upper guide plate 40 (FIG. 2) is easily removable from the frame 12 of the separator 10. The upper guide plate 40 is held in place on the sub-frame 34 with only the two bolts 88 and the two pins 98. The engagement of the pins 98 in the slots 96 supports the inlet end 83 of the upper guide plate 40 on the sub-frame 34.

To remove the upper guide plate 40 from the separator 10, the two bolts 88 are first removed. Then, the upper guide plate 40 is slid longitudinally toward the outlet end 20 of the separator 10, until the pins 98 can come out of the slots 96, a distance which may be about one inch, for example. When the pins 98 come out of the slots 96, the inlet end 83 of the upper guide plate 40 drops down. At that point, the upper guide plate 40 can easily be pulled longitudinally out of the separator 10, in a direction toward the outlet end 20 of the separator 10. The separator 10 does not have to be moved away from the dryer to accomplish this, nor do any other parts of the separator have to be removed first.

In accordance with yet another aspect of the invention, the vertical position of the upper pole piece 42 is easily adjustable from the top of the separator 10. The upper pole piece 42 (FIG. 4) includes a frame 150 that supports two permanent magnets 152. The magnets 152 extend along the length of the separator 10. The frame 150 is supported at each end on two adjustment screws 154 that are threaded in the upper guide plate 40. The frame 150 and the adjustment screws 154 are thus supported on the upper guide plate 40 for movement with the upper guide plate.

The heads of the adjustment screws 154 are accessible from above the upper pole piece 42 and the upper guide plate 40. The separator 10 includes an upper cover 156 that has removable plugs 158 fitted in openings 160 in the upper cover. When one of the plugs 160 is removed as shown in FIG. 4, the head of the associated adjustment screw 154 is accessible. The adjustment screw 154 can be reached with a socket on a six-inch extension on a socket wrench as shown in phantom at 162.

Rotation of the adjustment screw 154 at one end of the upper pole piece 42 causes that end of the upper pole piece to move upward or downward, as desired, relative to the upper guide plate 40. The vertical position of the upper pole piece 42 can thus be set separately from the vertical position of the upper guide plate 40. Alternatively, the upper pole piece 42 can be set a particular distance away from the upper guide plate 40, then moved vertically with the upper guide plate along the frame 12.

As a result, the upper pole piece 42 is adjustably supported by the upper guide plate 40 on the frame 12, so that it can be positioned at different vertical locations relative to the frame 12 and also, separately, relative to the upper guide plate.

Having described the invention, we claim:

1. A magnetic separator for spacing a plurality of workpieces in face-to-face relationship, said separator comprising:

an upper guide plate and a lower guide plate that define a passage having an inlet opening and an outlet opening for workpieces moving through said separator, said inlet opening having a funnel-shaped configuration adapted to admit and align any misaligned workpieces moving into said passage;

an upper pole piece adjacent said upper guide plate and a lower pole piece adjacent said lower guide plate, said upper and lower pole pieces providing a magnetic field operative to orient workpieces in said passage; and an adjustment mechanism for adjusting the vertical position of said upper guide plate relative to said lower guide plate;

said adjustment mechanism comprising a member that is rotatable about an axis, said rotatable member having a first portion fixed for vertical movement with said upper guide plate and a second portion that is threadedly received in a frame portion of said separator, rotation of said rotatable member about said axis causing axial movement of said rotatable member and thereby of said upper guide plate relative to said frame portion;

wherein said lower guide plate has an intermediate portion that extends between an inlet end portion and an outlet end portion of said lower guide plate, said inlet end portion of said lower guide plate extending parallel to said intermediate portion of said lower guide plate;

said upper guide plate having an intermediate portion that extends between an inlet end portion and an outlet end portion of said upper guide plate, said inlet end portion of said upper guide plate extending transverse to said intermediate portion of said upper guide plate; and wherein said passage has an intermediate portion disposed between said inlet opening and said outlet opening, said inlet opening being substantially larger in cross-sectional area than said intermediate portion of said passage.

2. A separator as set forth in claim 1 wherein a portion of said inlet end portion of said upper guide plate is flared upward to form said funnel-shaped configuration.

3. A separator as set forth in claim 2 wherein said upper guide plate has a V-shaped wall, an end portion of which is bent upward into tabs to form said funnel-shaped configuration.

4. A separator as set forth in claim 1 wherein one of said upper and lower guide plates has a view port for enabling viewing of said passage from a location other than said inlet opening and said outlet opening.

5. The magnetic separator of claim 1 wherein said rotatable member first end is rotatably captured by said upper guide plate.

6. The magnetic separator of claim 1 wherein said an upper pole piece supports an upper magnet adjacent said upper guide plate and said lower pole piece supports a lower magnet adjacent said lower guide plate.

7. The magnetic separator of claim 1 wherein said separator is adapted to separate a plurality of substantially plate-like metal workpieces.

8. The magnetic separator of claim 1 further comprising an adjustment mechanism for adjusting the vertical position of said lower pole piece relative to lower upper guide plate.

9. The magnetic separator of claim 1 further comprising a frame on which said upper guide plate is supported, wherein said adjustment mechanism adjusts the vertical position of said upper pole piece relative to said frame.

* * * * *